United States Patent [19]

Coster

[11] 4,437,665

[45] Mar. 20, 1984

[54] DICE BOX

[76] Inventor: Ora Coster, 7 Bet Horon St., Tel Baruch 69987, Israel

[21] Appl. No.: 347,358

[22] Filed: Feb. 9, 1982

[51] Int. Cl.[3] ..... A63F 9/04

[52] U.S. Cl. ..... 273/138 R; 46/106; 273/146

[58] Field of Search ..... 273/143 R, 143 A, 143 B, 273/143 C, 143 D, 143 E, 147, 138 R, 145 C, 145 CA, 145 E, 146; 46/135 R, 167, 104, 106

[56] References Cited

U.S. PATENT DOCUMENTS

| | | | |
|---|---|---|---|
| 935,258 | 9/1909 | Immer | 273/143 A |
| 1,593,907 | 7/1926 | Madan | 273/146 |
| 1,619,393 | 3/1927 | Austin | 273/138 R |
| 1,857,902 | 5/1932 | Weber | 273/143 E |
| 2,085,414 | 6/1937 | Cavanagh | 46/167 X |
| 3,186,125 | 6/1965 | Orel | 46/104 |
| 3,467,382 | 9/1969 | Leadley | 273/146 X |
| 4,239,221 | 12/1980 | Griffin | 273/146 X |

FOREIGN PATENT DOCUMENTS

| | | | |
|---|---|---|---|
| 23058 | 7/1883 | Fed. Rep. of Germany | 273/143 E |
| 488334 | 12/1929 | Fed. Rep. of Germany | 273/143 R |
| 634076 | 8/1936 | Fed. Rep. of Germany | 273/145 C |
| 662483 | 7/1938 | Fed. Rep. of Germany | 273/143 A |
| 821018 | 11/1951 | Fed. Rep. of Germany | 273/147 |
| 852516 | 10/1952 | Fed. Rep. of Germany | 273/143 |
| 1425316 | 12/1965 | France | 273/146 |
| 628899 | 9/1949 | United Kingdom | 273/145 CA |

*Primary Examiner*—Robert A. Hafer
*Assistant Examiner*—Arnold W. Kramer
*Attorney, Agent, or Firm*—Browdy and Neimark

[57] ABSTRACT

Pattern generating apparatus including a housing defining a plurality of sockets and a plurality of pattern bearing elements rotatably retained in the plurality of sockets. The pattern bearing elements may be dice or other pattern bearing elements.

5 Claims, 6 Drawing Figures

DICE BOX

FIELD OF THE INVENTION

The present invention relates to toys and games generally and more particularly to toys and games having random pattern generating apparatus.

BACKGROUND OF THE INVENTION

Toys and games incorporating random pattern generating apparatus are extremely widespread. Perhaps the best known form of random pattern generating apparatus are dice, which define chance generating means for a number of different games. Normally dice are held in a player's hand and thrown or dropped onto a playing surface in order to determine in a more or less random way one pattern forming part of a set of possible patterns. Dice of various configurations, including dice having rounded corners are known.

The use of dice or other chance generating devices such as patterned cards involves a significant disadvantage in that the dice or cards are relatively easy to lose, during transport or storage or even during play. A further difficulty with dice is the requirement for a level and stable surface of at least a minimum area onto which to throw the dice.

Various games employing dice located in a housing are described in the patent literature. U.S. Pat. No. 3,204,345 shows a mathematical game comprising a plurality of dice freely disposed in a housing U.S. Pat. No. 1,663,074 shows an improved dice box, as does U.S. Pat. No. 2,636,741. U.S. Pat. No. 1,968,885 shows a mechanical dice throwing device. U.S. Pat. No. 1,593,907 shows a type of dice comprising two dice, one formed within the other.

SUMMARY OF THE INVENTION

The present invention seeks to provide random pattern generating apparatus which overcomes the above-described disadvantages.

There is thus provided in accordance with an embodiment of the present invention random pattern generating apparatus comprising a housing defining a plurality of sockets and a plurality of pattern bearing elements rotatably retained in the sockets.

Further in accordance with a preferred embodiment of the present invention, the housing defines first and second planar surfaces and the plurality of sockets communicates with at least one of the planar surfaces, via apertures formed in that surface.

Additionally in accordance with an embodiment of the present invention, the pattern bearing elements each define a plurality of pattern bearing planar surfaces and are arranged with respect to the sockets such that when a pattern bearing planar surface is not oriented parallel to an aperture bearing planar surface, a portion of the pattern bearing element protrudes beyond the aperture bearing planar surface.

Further in accordance with a preferred embodiment of the present invention, the first and second planar surfaces of the housing are both formed with apertures communicating with the sockets and the pattern bearing planar surface define the sides of a cube.

BRIEF DESCRIPTION OF THE DRAWING

The present invention will be more fully understood and appreciated from the following detailed description taken in conjunction with the drawings in which.

DETAILED DESCRIPTION OF THE INVENTION

Figure 2:
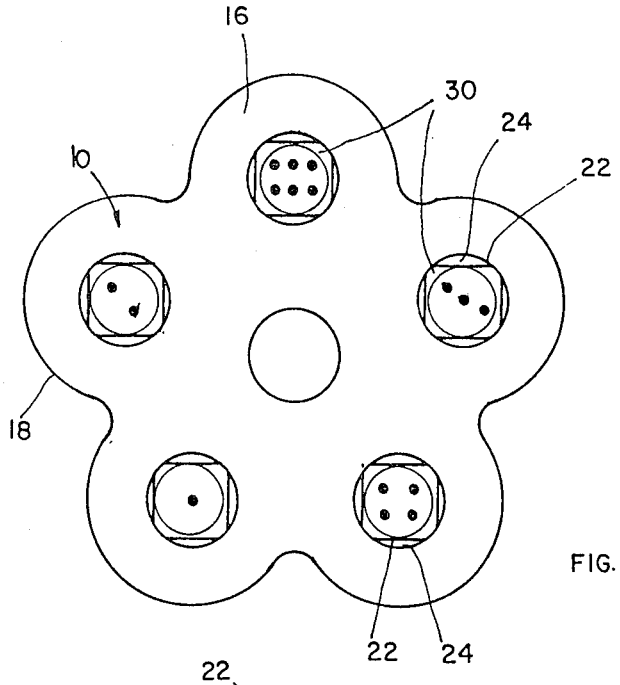
FIG. 2 is a plan view illustration of the pattern generating apparatus of the present invention with the pattern bearing elements in a non-protruding arientation.

Reference is now made to FIGS. 1–5 which illustrate pattern generating apparatus constructed and operative in accordance with a preferred embodiment of the present invention. The pattern generating apparatus comprises a housing 10, typically formed of two identical halves 12 and 14 (FIG. 5) which are fused together by known techniques. Each half comprises a planar surface 16 and a peripheral surface 18. The shape and side of the planar surface and the configuration of the peripheral surface may be as desired. Reinforcing ribs 20 may be provided as required to insure mechanical stability of the apparatus.

A plurality of apertures 22, typically of circular configuration are formed in facing relationship and in registration with each other on planar surfaces 16. The apertures 22 on opposite planar surfaces 16 are preferably of the same size, although different size apertures in pairs may be provided along the surfaces of planar surfaces 16.

Each pair of registered apertures 22 defines a socket 24 which is operative to rotatably retain a pattern bearing element 26. According to a preferred embodiment of the present invention, pattern bearing elements 26 are cubic blocks bearing patterns on each of their six side surfaces 28. Each of the side surfaces is planar and either parallel or perpendicular to each other surface. The corners 30 of the pattern bearing elements 26 are preferably rounded as illustrated, thus defining a modified sphere having a plurality of planar surfaces.

Due to the rounded configuration of the corners 30 of the pattern bearing elements 26, the pattern bearing elements 26 are freely and generally smoothly rotatable within sockets 24 but are retained against escape therefrom irrespective of the orientation of the pattern bearing element in the socket.

It may thus be appreciated that the diameter of apertures 22 is selected to be less than the diameter of the sphere thus effecting positive retention of the pattern bearing elements in the sockets 24.

The pattern bearing elements 26 may carry any desired pattern whether colored or not. They may carry, for example, a dice pattern and function as dice.

It is appreciated that the pattern bearing elements 26 always protrude at least slightly beyond planar surfaces 16.

Figure 1:
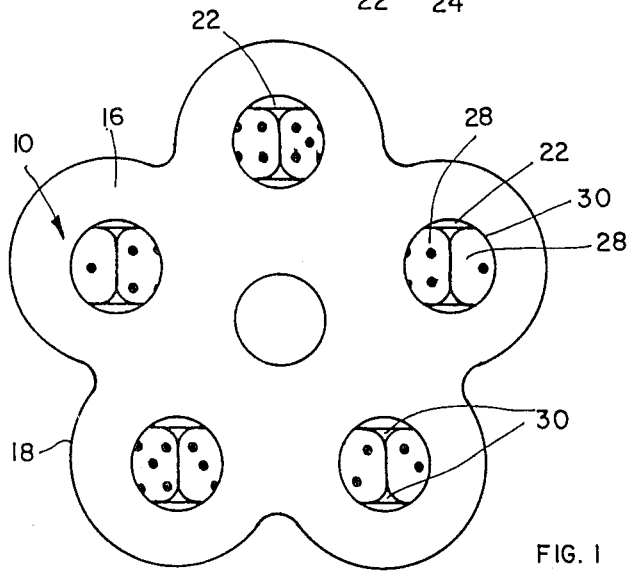
FIG. 1 is a plan view illustration of the pattern generating apparatus of the present invention with the pattern bearing elements in a protruding orientation.
Figure 3:
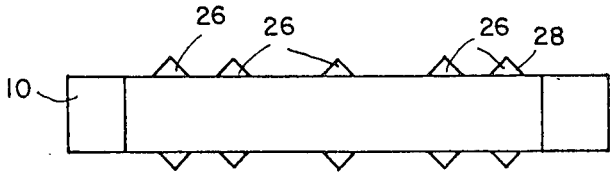
FIG. 3 is a side view of the pattern generating apparatus corresponding to FIG. 1.

It is a particular feature of the present invention that the pattern generating apparatus of the present invention may be used in various situations where escape, even temporary of the pattern bearing elements would not be acceptable, or where no level surface for ordinary play with pattern bearing elements, such as dice, exists. The positions of the individual pattern bearing elements in the pattern generating apparatus of the present invention may be randomly determined by causing the apparatus to traverse a non smooth engaging surface, such as a human hand or a piece of clothing draped over a part of a human body, such as a leg. Such engagement causes the individual pattern bearing elements 26 to assume various orientations, some of them being in a parallel orientation, as illustrated in FIGS. 1 and 4 with pattern bearing surface 28 lying parallel to a planar surface and others being in a skewed orientation as seen in FIGS. 1 and 3, with corners of the cube protruding beyond the planar surface.

Figure 4:
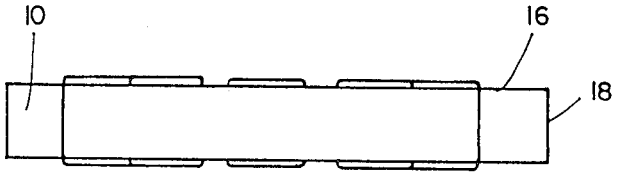
FIG. 4 is a side view of the pattern generating apparatus corresponding to FIG. 2.
Figure 5:
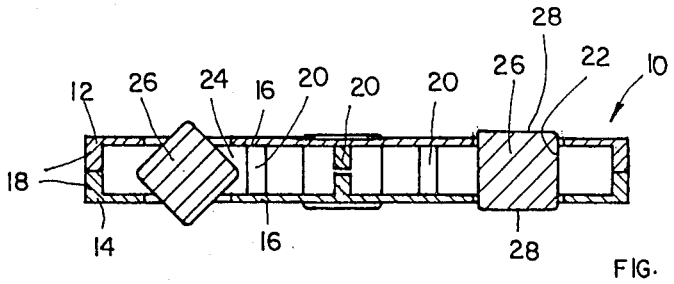
FIG. 5 is a sectional illustration of the pattern generating apparatus of the preceding Figures, having part of the pattern bearing elements in a protruding orientation and part of the pattern bearing elements in a non-protruding orientation.

Since a clear pattern indication is not provided by a pattern bearing element 26 when it is in a skewed position, it is desirable to bring all of the pattern bearing elements 26 into a parallel orientation, as seen in FIGS. 2 and 4. This is readily accomplished by placing the apparatus of the invention against a small flat surface and slightly and momentarily vibrating the apparatus. This settling motion causes all of the pattern bearing elements 26 to settle into a parallel orientation.

It may be appreciated that the apparatus illustrated in FIGS. 1–5 provides a chance generating device which may take the place of loose dice or other types of chance generating means while providing ease of use.

Figure 6:
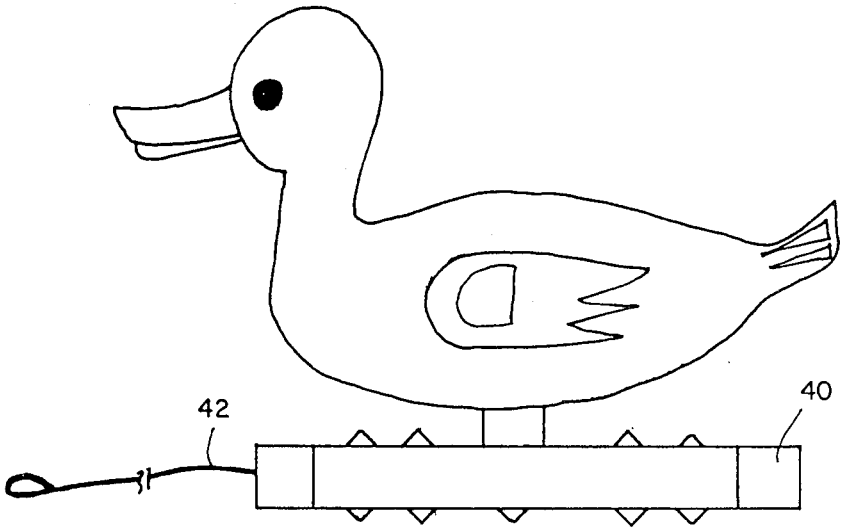
FIG. 6 is a side view illustration of a children's pull toy having as its base pattern generating apparatus of the present invention.

Reference is also made to FIG. 6 which illustrates a child's pull toy with a pattern generating base 40. The base 40 is typically formed of a structure which may be substantially similar to that illustrated in FIGS. 1–5 and wherein the patterns formed on the pattern bearing surfaces 28 may be colors or alternatively figures or any other desired patterns. The toy of FIG. 6 is particularly suited for being pulled on a non-smooth surface such as a carpet or rug by means of a pull string 42.

It will be appreciated by persons skilled in the art that the present invention is not limited to what has been particularly shown and described hereinabove. Rather the scope of the present invention is defined only by the claims which follow:

I claim:

1. Pattern generating apparatus comprising:

a housing defining first and second parallel planar surfaces, said surfaces being formed with apertures arranged in facing registration and defining a plurality of sockets; and a plurality of pattern bearing elements universally rotatably retained in said plurality of sockets, each element defining pairs of parallel opposite pattern bearing planar surfaces, said elements being arranged with respect to said sockets such that, when said housing is disposed adjacent a flat surface, each of said pattern bearing elements engages said surface and is universally rotatable thereby so that when one of said pattern bearing surfaces lies parallel to said first parallel planar surface the opposite parallel pattern bearing surface is caused to lie parallel to said second parallel planar surface whereby a clear pattern indication is displayed through said apertures.

2. Pattern generating apparatus according to claim 1 and wherein said pattern bearing elements comprise cubes, having rounded corners.

3. Pattern generating apparatus according to claim 1 and wherein said pattern bearing elements comprise six sided cubes having dice insignia thereupon, are rounded corners.

4. Pattern generating apparatus according to claim 1 and wherein the diameter of said apertures being less than the diameter of the sphere defined by any of the plurality of pattern bearing elements.

5. Pattern generating apparatus according to claim 1 and also comprising towing means attached to said housing for permitting said pattern generating apparatus to be pulled along a support surface.

* * * * *